US007793785B2

(12) United States Patent
Keffeler et al.

(10) Patent No.: US 7,793,785 B2
(45) Date of Patent: Sep. 14, 2010

(54) MEDICATION DISPENSER

(76) Inventors: Mark G. Keffeler, c/o OPUS, 8939 "F" St., Omaha, NE (US) 68127; David P. Keffeler, c/o OPUS Medication Systems, 8939 "F" St., Omaha, NE (US) 68127-1401

( * ) Notice: Subject to any disclaimer, the term of this patent is extended or adjusted under 35 U.S.C. 154(b) by 18 days.

(21) Appl. No.: 12/075,423

(22) Filed: Mar. 11, 2008

(65) Prior Publication Data

US 2009/0230014 A1 Sep. 17, 2009

(51) Int. Cl.
*B65D 83/04* (2006.01)
*B65D 41/32* (2006.01)

(52) U.S. Cl. ..... 206/538; 206/532; 220/266; 220/524

(58) Field of Classification Search ..... 206/532, 206/528, 538, 535, 539, 561, 536, 533; 220/523, 220/524, 23.83, 538, 507, 526, 500
See application file for complete search history.

(56) References Cited

U.S. PATENT DOCUMENTS 3,630,171 A * 12/1971 Huck ..... 116/308
4,084,695 A * 4/1978 Halbich ..... 206/532
4,372,445 A 2/1983 Keffeler
4,735,318 A 4/1988 Keffeler
4,741,441 A 5/1988 Keffeler
4,793,492 A * 12/1988 Halbich ..... 206/538
5,011,018 A 4/1991 Keffeler
5,558,229 A * 9/1996 Halbich ..... 206/534
5,579,941 A * 12/1996 Romick ..... 220/23.86
5,735,406 A 4/1998 Keffeler
D473,372 S * 4/2003 Weitzman ..... D3/203.3
7,097,037 B1 8/2006 Keffeler et al.
7,267,228 B2 9/2007 Keffeler et al.
D578,386 S * 10/2008 Silvenis et al. ..... D9/424
7,624,890 B2 * 12/2009 Noble et al. ..... 220/324

* cited by examiner

*Primary Examiner*—Mickey Yu
*Assistant Examiner*—Chun Cheung
(74) *Attorney, Agent, or Firm*—Dennis L. Thomte; Thomte Patent Law Office LLC

(57) ABSTRACT

A medication dispenser including a container having a bottom, first and second upstanding sidewalls and first and second upstanding end walls with the container or liners positioned therein defining a plurality of open topped medication compartments. A plurality of compartment covers overlie and close the compartments to maintain medication within the compartments. Each of the covers has an outwardly extending tab or extension which assists in the opening of the cover. The upper ends of the sidewalls of the container are provided with a plurality of spaced-apart protrusions which extend outwardly from the associated sidewall beyond the outer ends of the tabs on the covers to shield the tabs to prevent inadvertent opening of the covers.

4 Claims, 4 Drawing Sheets

MEDICATION DISPENSER

BACKGROUND OF THE INVENTION

1. Field of the Invention

This invention relates to a medication dispenser and more particularly to a medication dispenser which includes means to prevent the inadvertent removal of the covers positioned over the open topped medication compartments.

2. Background of the Invention

Applicants' father received U.S. Pat. Nos. 4,372,445; 4,735,318; 4,741,441; 5,011,018; and 5,735,406 relating to medication dispensers. Applicants have received U.S. Pat. Nos. 7,097,037 and 7,267,228 which also relate to medication dispensers. In all of the above identified patents, a container or cassette is disclosed which has a plurality of open topped medication compartments forms therein which have compartment covers selectively closing the upper ends thereof.

The individual compartment covers are normally connected together by fracturable links. The outer ends of the individual covers have a semi-circular extension or tab extending outwardly therefrom beyond the upper ends of the side walls of the container to enable a person to raise the outer end of the cover so as to fracture the link at the inner end of the cover to open the compartment to enable the medication therein to be removed.

Although the medication dispensers of the patents noted above have met with considerable success, it has been discovered that the protruding extensions or tabs may sometimes be contacted or struck which causes the inner end of one or more of the covers to be inadvertently broken or fractured thereby causing the medication to be spilled from the compartment or compartments.

SUMMARY OF THE INVENTION

The medication dispenser of the present invention includes a unitary container having several unit-dose compartments formed therein. The container includes a bottom, first and second upstanding sidewalls and first and second upstanding end walls. The compartments may be formed in the container or may be provided by way of one or more liners inserted into the container with the liners having the medication compartments formed therein. A plurality of compartment covers are adapted to overlie and enclose the medication compartments. Each of the covers has inner and outer ends with each of the covers including a separate fractional tab depending therefrom from the inner end thereof. Each of the covers has a horizontally dispose cover lifting tap or extension extending outwardly from the outer end of the cover beyond the upper end of the associated sidewall of the container. Each of the first and second sides of the container have spaced-apart protrusions or extensions extending outwardly from the exterior surface of the associated sidewall adjacent to the upper end thereof. The protrusions or extensions have outer ends which are positioned outwardly of and below the outer ends of the cover lifting tabs or extensions. The extensions which extend outwardly from the sidewalls of the container shield the cover lifting tabs from being inadvertently struck or contacted to prevent the inadvertent opening of the compartment covers.

A principal object of the invention is to provide an improved medication dispenser.

A further object of the invention is to provide a medication dispenser wherein the opposite side walls of the container of the dispenser have spaced-apart protrusions or extensions extending therefrom beyond the cover lifting tabs of the individual covers which close the upper open ends of the medication compartments.

Another object of the invention is to provide a medication dispenser which includes means thereon to prevent the inadvertent opening of the compartment covers thereof.

These and other objects will be apparent to those skilled in the art.

DESCRIPTION OF THE PREFERRED EMBODIMENT

Figure 1:
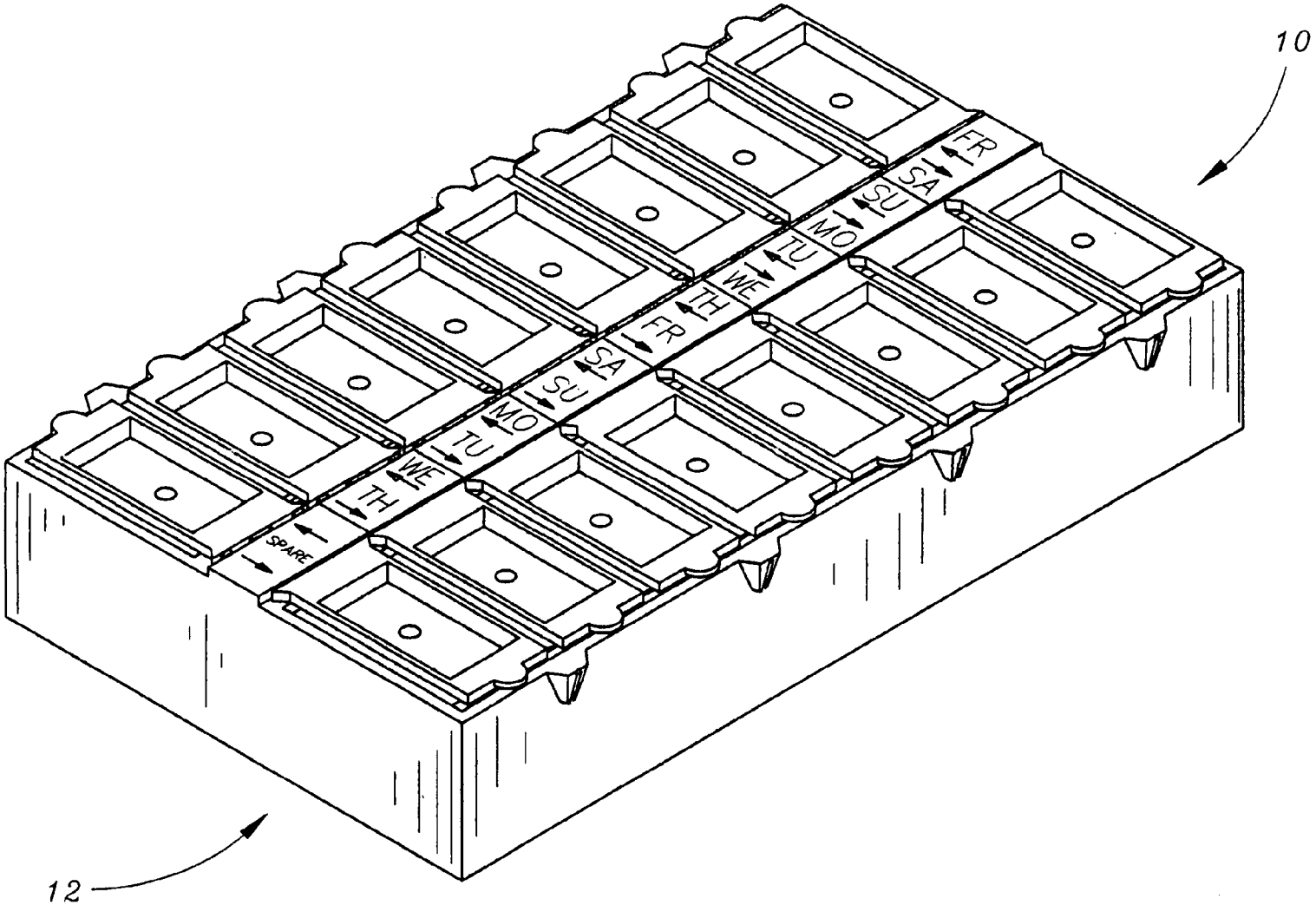
FIG. 1 is a perspective view of a typical medication container having the means of this invention associated therewith to prevent the inadvertent opening of the covers which overlie the medication compartments.
Figure 2:
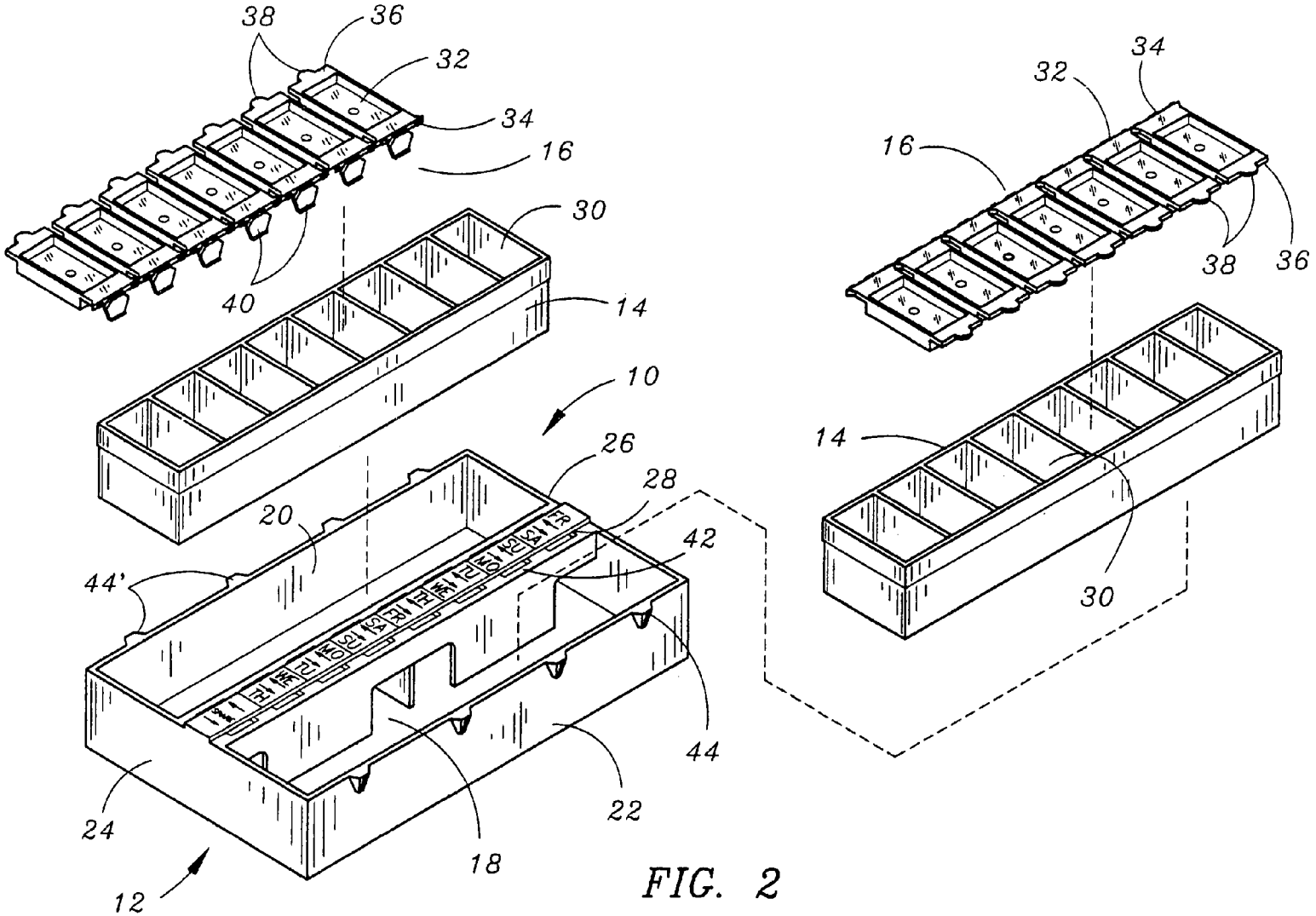
FIG. 2 is an exploded perspective view of one form of the medication dispenser which includes liners for insertion into the container or cassette to provide the medication compartments.

The numeral 10 refers generally to the medication dispenser of this invention which includes a container 12, a pair of removable multi-compartment liners 14 and a pair of compartment cover assemblies 16. Container 12 includes a bottom wall 18, opposite upstanding sidewalls 20 and 22, opposite upstanding end walls 24 and 26 and a divider wall assembly 28. The liners 14 define a plurality of individual medication compartments 30. However, in some cases, the liners 14 will not be utilized but the container 12 will have partitions provided therein which form the medication compartments 30. Each of the cover assemblies 16 include a plurality of covers 32 having an inner 34 and an outer end 36. A protrusion or extension 38 extends outwardly from the outer end 36 of the cover 32 and serves as a cover lifting tab. The covers 32 are normally joined together and include fractable tabs 40 at the inner ends thereof which are received by the elongated openings 42 formed in divider wall assembly 28. The cover assemblies 16 overlie the liners 14 or the compartment formed in the container 12 if that be the case. Medication is placed in the compartments 30 with the divider wall 28 indicating the particular days which the medication will be used.

When it is desired to remove the medication from one of the compartments 30, upward force on the extension 38 of the cover 32 causes the tab 40 to fracture so that access to the associated compartment 30 is achieved. The structure described heretofore is conventional and the teachings of the above-identified patents is incorporated herein by reference to complete the disclosure.

Figure 3:
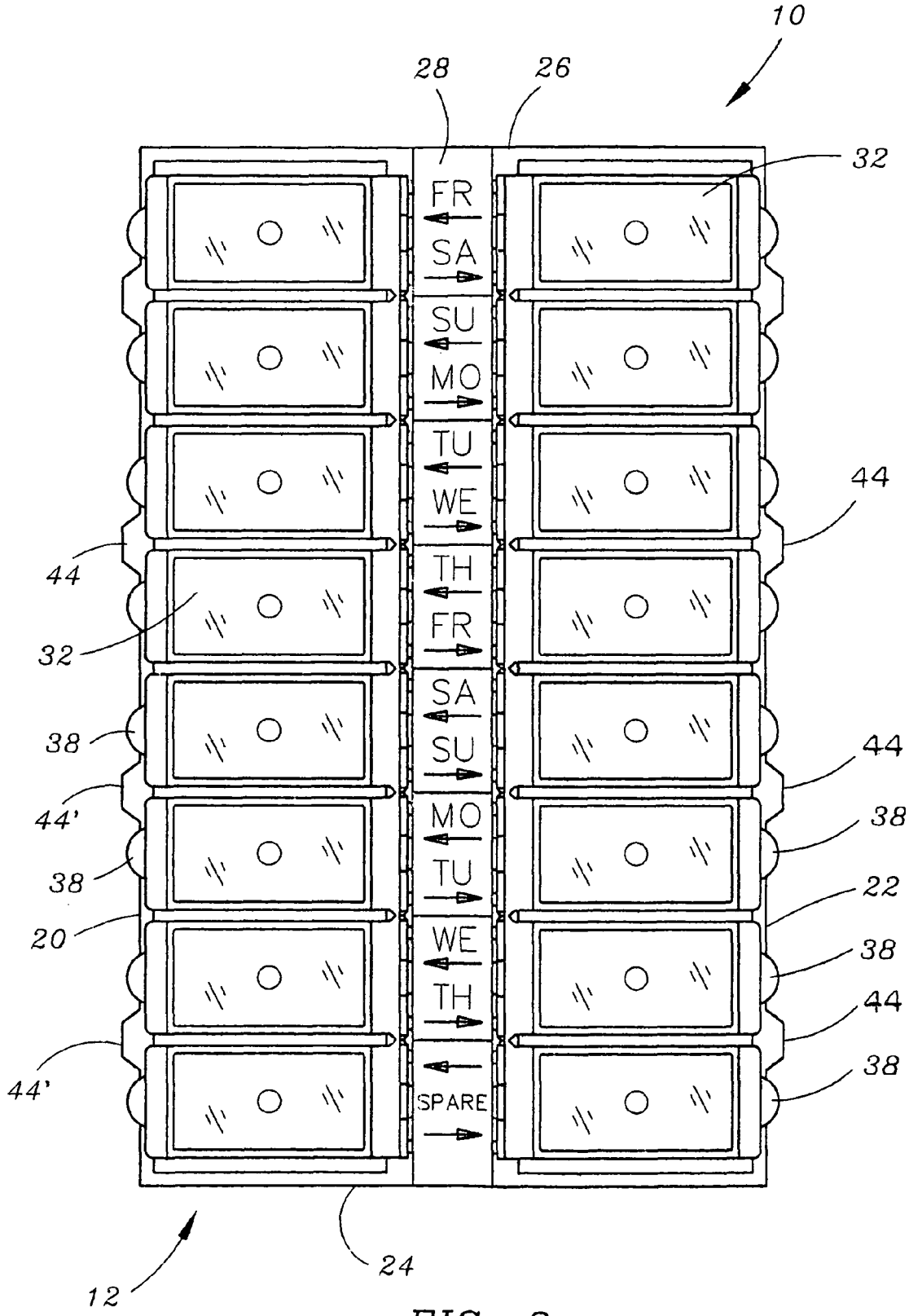
FIG. 3 is a top view of the medication dispenser of FIG. 1.

As stated in the background of the invention, since the tabs or extensions 38 extend outwardly beyond the exterior surfaces of the side walls 20 and 22 of the container 12 as illustrated in FIG. 3, the exposed portions of those tabs 38 sometimes result in them being struck by a cabinet, door, drawer, etc. which causes several of the covers 32 to be moved upwardly with respect to the container 12 which causes a fracture of the tabs 40 so that the covers 32 separate from the dispenser 12. It is for that reason that the instant invention to be described hereinafter is provided.

Figure 4:
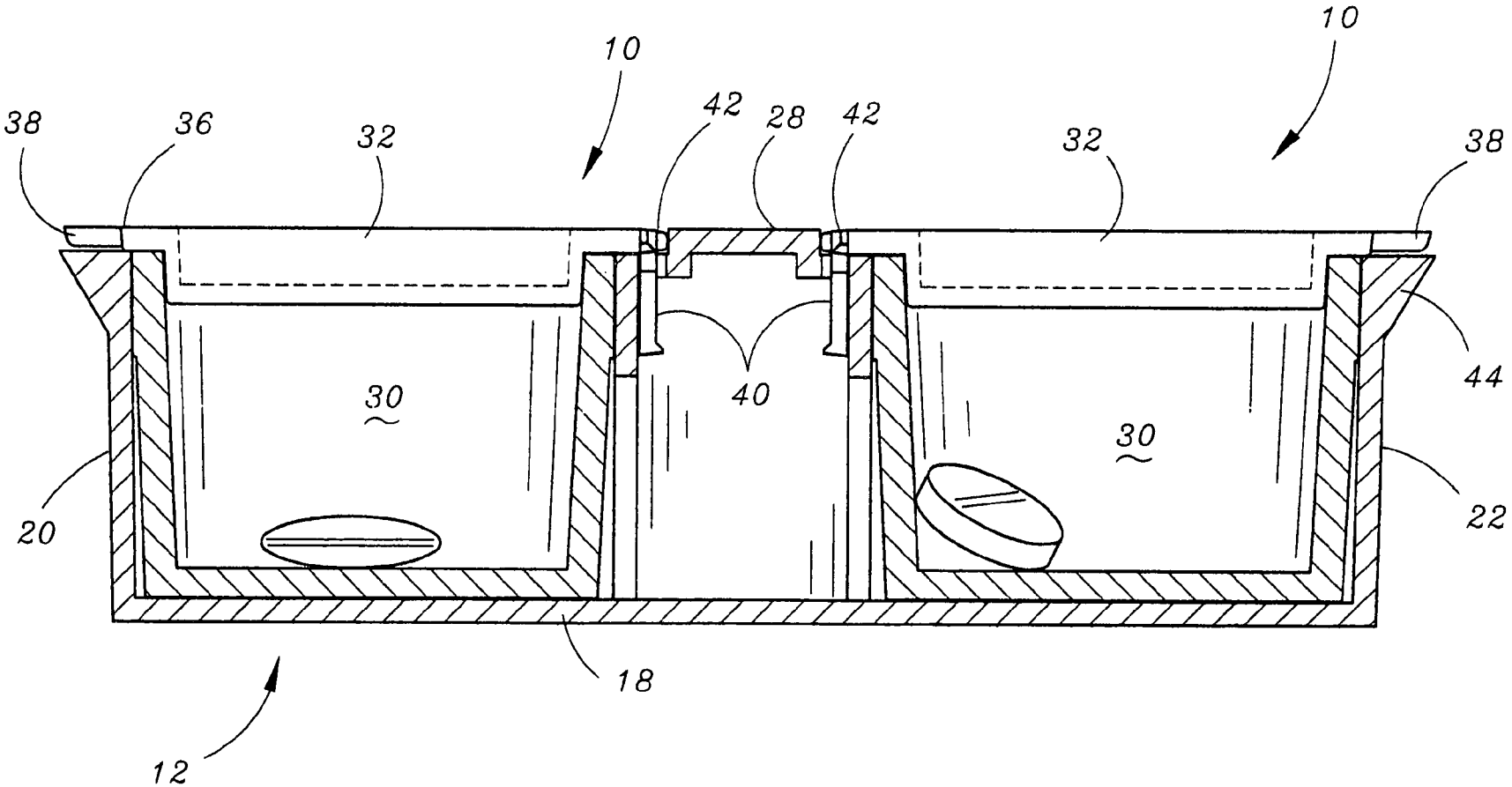
FIG. 4 is a transverse sectional view of the medication dispenser of FIG. 1 which illustrates the protrusions or extensions on the sidewalls of the container which extend outwardly beyond the cover lifting tabs thereof.

A plurality of extensions or protrusions 44 are preferably integrally formed with the container 12 and extend outwardly from the upper end of sidewall 22 in a spaced-apart relationship and extend beyond the outer ends of the tabs or extensions 38 as illustrated in FIGS. 3 and 4 to shield the tabs or extensions 38 from being struck or bumped by some object which could possibly cause the covers 32 to be opened inadvertently. As seen in FIG. 3, the protrusions or extensions 44 are positioned between adjacent pairs of tabs 28 so that the tabs 28 may still be grasped by a person's finger to open the cover 32 to gain access to medication within the particular compartment 30. Similarly, protrusions 44' extend outwardly from the upper end of sidewall 20 beyond the outer ends of the tabs or extensions 38 as illustrated in FIG. 3.

The fact that the outer ends of the tabs 38 are shielded by the protrusions 44 and 44' prevents the tabs or extensions 38 from being struck or bumped by some outside agency or object to ensure that the covers 32 will not be inadvertently opened and/or separated from the medication dispenser.

Therefore, it can be seen that the invention accomplishes at least all of its stated objectives.

The invention claimed is:

1. A medication dispenser, comprising:

a container comprising a bottom, first and second upstanding side walls having upper and lower ends and inner and outer surfaces, first and second upstanding end walls having upper and lower ends and inner and outer surfaces;

said container having a plurality of open topped medication compartments provided therein;

a plurality of compartment covers, each adapted to overlie and close a respective one of said compartments;

each of said covers having inner and outer ends and opposite side edges;

each cover including a fractuable tab depending therefrom from said inner end thereof;

each of said covers having a cover lifting tab depending therefrom which extends outwardly from said outer end thereof beyond the upper end of the associated side wall of the container;

each of said first and second side walls of said container having spaced-apart protrusions extending outwardly from the outer surface thereof adjacent said upper end thereof;

said protrusions having outer ends which are positioned outwardly of and below said outer ends of said cover lifting tabs;

said protrusions being positioned between said cover lifting tabs;

said protrusions being integrally formed with said container;

each of said protrusions having an upper end with a width sufficient so as to be positioned directly below the side edges of a pair of adjacent covers; each of said protrusion having a width greater than the distance between said side edges of the pair of adjacent covers.

2. The medication dispenser of claim 1 wherein the number of protrusions on each of said side walls are one-half of the number of compartments adjacent the associated side wall.

3. The medication dispenser of claim 1 wherein at least one liner is positioned in said container which has the plurality of medication compartments formed therein.

4. The medication dispenser of claim 1 wherein said container is comprised of a plastic material and wherein said protrusions are integrally formed therewith.

* * * * *